United States Patent [19]

Atsumi et al.

[11] Patent Number: 4,562,700

[45] Date of Patent: Jan. 7, 1986

[54] REFRIGERATION SYSTEM

[75] Inventors: Akira Atsumi, Shimizu; Takao Senshu, Ibaraki; Kensaku Oguni, Shimizu; Hirokiyo Terada, Shizuoka; Kazuo Yoshioka, Shimizu, all of Japan

[73] Assignee: Hitachi, Ltd., Tokyo, Japan

[21] Appl. No.: 621,372

[22] Filed: Jun. 18, 1984

[30] Foreign Application Priority Data

Jun. 17, 1983 [JP] Japan ..... 58-107654

[51] Int. Cl.[4] ..... F25B 41/00

[52] U.S. Cl. ..... 62/174; 62/509

[58] Field of Search ..... 62/174, 324.4, 509

[56] References Cited

U.S. PATENT DOCUMENTS 1,703,965 3/1929 Shipley ..... 62/174 X 3,237,422 3/1966 Pugh ..... 62/174 X

FOREIGN PATENT DOCUMENTS 55-47296 11/1980 Japan .

*Primary Examiner*—William E. Wayner

*Attorney, Agent, or Firm*—Antonelli, Terry & Wands

[57] ABSTRACT

A refrigeration system suitable for use in an air conditioner has a main refrigerant circuit including a compressor, a condenser, a first pressure reducer, a gas-liquid separator, a second pressure reducer and an evaporator connected in series to form a closed loop, and a gas injection passage providing a communication between the gaseous phase part of the gas-liquid separator and a compression chamber of the compressor. A stop valve is disposed in the inlet and outlet pipes of the gas-liquid separator, and a bypass passage is provided for connecting directly the outlet pipe of the condenser to the inlet pipe of the evaporator to bypass the gas-liquid separator. The stop valve is adapted to be controlled such that, when the gas injection to the compressor through the gas injection passage is not conducted, the refrigerant flows through the bypass passage bypassing the gas-liquid separator, while the gas-liquid separator functions as a receiver for adjusting the amount of refrigerant circulated in the main refrigerant circuit.

18 Claims, 7 Drawing Figures

REFRIGERATION SYSTEM

BACKGROUND OF THE INVENTION

The present invention relates to a refrigeration system for use in an air-conditioner and, more particularly, to a refrigerant circuit of the refrigeration system, provided with a gas injection passage.

Generally, a refrigerant circuit of a refrigeration system has a closed loop constituted by a compressor, a condenser, a first pressure reducer, a gas-liquid separator, a second pressure reducer and an evaporator. When this refrigeration system is used in an air-conditioner, a gas injection passage provides a communication between the upper side of the gas-liquid separator and an intermediate stage of the compressor to inject refrigerant gas into the refrigerant which is being compressed to, increases the cooling or heating power of the air-conditioner.

In operation, the refrigerant gas discharged under high pressure from the compressor is introduced into the condenser and is liquefied in the condenser by radiating the heat through a heat exchange with an external fluid such as air or water. The liquid refrigerant is then depressurized to an intermediate pressure through the first pressure reducer so that a part of the refrigerant is evaporated. The liquid and gaseous phases of the refrigerant are then introduced into the gas-liquid separator and are separated from each other. The liquid phase of the refrigerant is extracted from the bottom of the gas-liquid separator and is introduced through the second pressure reducer to the evaporator which is held at a predetermined reduced pressure. In the evaporator, this liquid phase is evaporated through heat absorption from the external fluid such as air or water to become gaseous refrigerant which, in turn, is sucked by the compressor.

On the other hand, the gaseous refrigerant separated in the gas-liquid separator and accumulated in the upper part of the latter is injected through the gas injection passage into the intermediate stage of the compressor to merge in the refrigerant gas which is being compressed, thereby enhancing the heating or cooling power of the air-conditioner. However, if the refrigerant gas separated in the gas-liquid separator is injected into the compressor independently of the load demand, the pressure and temperature of the refrigerant gas discharged from the compressor will be increased excessively to unfavorable decrease the efficiency of the refrigeration cycle. In addition, the reliability of the air conditioner is impaired due to excessive temperature rise of the compressor and the motor by which the compressor is driven.

To avoid this problem, Japanese Patent Publication No. 47296/1980 proposes providing a stop valve in the gas injection passage and to close the same when the air conditioner is overloaded. This system, however, suffers from the following problem. Namely, if the pressure-reducing resistance of the first and second pressure reducers is selected optimumly for the gas injection, the flow rate of the refrigerant gas through the first pressure reducer is decreased when the gas injection circuit is closed to suspend the gas injection, as compared with the case where the gas injection is conducted, so that the refrigerant encounters smaller resistance across the second pressure reducer to cause the undesirable phenomenon of liquid back. Consequently, the refrigerating power, as well as the efficiency of the refrigeration cycle, are undesirably lowered.

The optimum flow rate of the refrigerant when the gas injection is conducted is substantially equal to that obtained when the gas injection is not conducted. In the prior art mentioned above, when the air conditioner is operating in the cooling mode, the liquid refrigerant accumulated in the gas-liquid separator is evaporated and discharged from the gas-liquid separator because the latter is heated by ambient air when the gas injection passage is closed, so that the flow rate of the refrigerant is seemingly increased. In order to optimize the flow rate of the refrigerant through the refrigeration cycle, therefore, it is necessary to provide a receiver for storing surplus refrigerant.

Japanese Utility Model Laid-Open No. 68454/1982 proposes another refrigerant circuit having a gas injection passage, in which no stop valve is provided in the gas injection passage. When the gas injection is not needed, only a part of the refrigerant is allowed to pass through the gas-liquid separator, while the other part flows bypass the gas-liquid separator. In this system, since a part of the refrigerant is allowed to flow to the evaporator through the gas-liquid separator even when the gas injection is not needed, the problem is encountered due to the fact that the gas-separator does not store surplus refrigerant.

Accordingly, an object of the invention is to provide a refrigeration system having a refrigerant circuit which can be switched between a first mode in which a gas injection is conducted (referred to as "gas injection mode", hereinafter) and a second mode in which the gas injection is not conducted (referred to as "non-injection mode", hereinafter) and which permits a control for optimizing the flow rates of the refrigerant in both of the first and second modes.

Another object of the invention is to provide a refrigeration system having a refrigerant circuit which can avoid excessive rise of pressure and temperature of the refrigerant gas discharged from the compressor while avoid liquid back to the compressor when the gas injection is not conducted.

To these end, according to one aspect of the invention, there is provided a refrigeration system having a main refrigerant circuit including a compressor, a condenser, a first pressure reducer, a gas-liquid separator, a second pressure reducer and an evaporator connected in series to form a closed loop, and a gas injection passage providing a communication between the gaseous phase part of the gas-liquid separator and a compression chamber of the compressor. A stop valve means is disposed in the inlet and outlet pipes of the gas-liquidified separator for opening and closing the inlet and outlet pipes when the injection of the refrigerant to the compressor is conducted and when the injection is not conducted, respectively. A bypass passage directly connects the outlet pipe of the condenser to the inlet pipe of the evaporator to bypass the gas-liquid separator. The stop valve means is adapted to be controlled such that, when the gas injection to the compressor through the gas injection passage is not conducted, the refrigerant flows through the bypass passage by-passing the gas-liquid separator, while the gas-liquid separator functions as a receiver for adjusting the amount of refrigerant circulated in the main refrigerant circuit.

According to another aspect of the invention, a refrigeration system is provided which comprises a heat-pump type refrigerant circuit including a compressor, a four-way valve, an outdoor heat exchanger, a pressure reducer for heating connected in parallel to a first check valve, a gas-liquid separator, a pressure reducer for cooling connected in parallel to a second check valve and an indoor heat exchanger connected in series, with the four-way valve being adapted to be switched over to switch the connection between the heat exchangers and the inlet and outlet pipes of the compressor. A gas injection passage provides a communication between the gaseous phase part of the gas-liquid separator and a compression chamber of the compressor and the pressure reducer for heating is used as a second pressure reducer for heating while the pressure reducer for cooling is used as a second pressure reducer for cooling. A stop valve means is disposed in the inlet pipe to the gas-liquid separator for opening and closing the inlet pipe when the injection of a refrigerant to the compressor is conducted and when the injection is not conducted, respectively. When the heat-pump type refrigerant circuit operates for cooling, the outlet side of the outdoor heat exchanger is connected to the second pressure reducer for cooling, through the first check valve, a first pressure reducer for cooling, the stop valve means in the inlet pipe to gas-liquid separator, interior of the gas-liquid separator, bottom of the gas-liquid separator, and a third check valve, whereas, when the heat-pump type refrigerant circuit operates for heating, the outlet side of the indoor heat exchanger is connected to the second pressure reducer for heating, through the second check valve, a first pressure reducer for heating, the stop valve means in the inlet pipe to the gas-liquid separator, interior of the gas-liquid separator, bottom of the gas-liquid separator and a fourth check valve. When the heat-pump type refrigerant circuit operates for cooling without gas injection, the first pressure reducer for cooling and the second pressure reducer for cooling are connected by a bypass passage for cooling by-passing the gas-liquid separator, whereas, when the heatpump type refrigerant circuit operates for heating without gas injection, the first pressure reducer for heating and the second pressure reducer for heating are connected through a bypass passage for heating bypassing the gas-liquid separator; whereby, when the injection of the refrigerant is not conducted, the refrigerant flows through either of the bypass passage for cooling and the bypass passage for heating bypassing the gas-liquid separator, while the gas-liquid separator serves as a reservoir for adjusting the amount of the refrigerant circulated through the refrigerant circuit.

In the refrigerant circuit of the invention, the refrigerant flows through the bypass passage bypassing the gas-liquid separator when the gas injection is not conducted, and the gas-liquid separator functions as a receiver for storing surplus refrigerant.

More specifically, when the gas injection is not conducted, the pressure of the refrigerant is reduced to a predetermined level through three pressure reducers connected in series: namely, the first pressure reducer, the auxiliary pressure reducer and the second pressure reducer.

In the non-injection mode, the flow rate of the refrigerant flowing through the first pressure reducer is small as compared with that in the gas-injection mode. Consequently, in order to optimize the flow rate of the refrigerant, it is necessary to increase the flow resistance of the refrigerant circuit. According to the invention, when the gas injection is not conducted, the auxiliary pressure reducer of the bypass passage takes part in the refrigeration circuit to optimize the flow resistance in the refrigeration circuit as a whole. It is, therefore, possible to maintain a moderate degree of dryness of the refrigerant at the evaporator outlet.

In addition, since the flow rate of the refrigerant in the refrigeration cycle is substantially equal in both modes, it is necessary to store the liquid refrigerant in the gas-liquid separator even in the non-injection mode. According to the invention, as explained before, the liquid refrigerant is held in the gas-liquid separator when the gas injection is not conducted, partly because the pressure in the gas-liquid separator is lower than the pressure at the inlet side of the second pressure reducer and partly because the inlet and outlet sides of the gas-liquid separator are closed by the solenoid valve and the check valve. Thus, in the non-injection mode of the refrigerant circuit, the gas-liquid separator serves also as a receiver for adjusting the amount of the refrigerant.

Consequently, according to the invention, it becomes possible to control the capacity of the refrigeration cycle, while optimizing the flow rate of the refrigerant, as well as the degree of dryness at the evaporator outlet, regardless of whether the gas injection is conducted or not.

In addition, it becomes possible to avoid any reduction of the refrigerating (cooling) power and heating power, as well as excessive rise of the discharge pressure and temperature, while avoiding the liquid back to the compressor in the non-injection mode.

These and other objects, features and advantages of the invention will become clear from the following description of the preferred embodiments taken in conjunction with the accompanying drawings.

DETAILED DESCRIPTION

Figure 1:
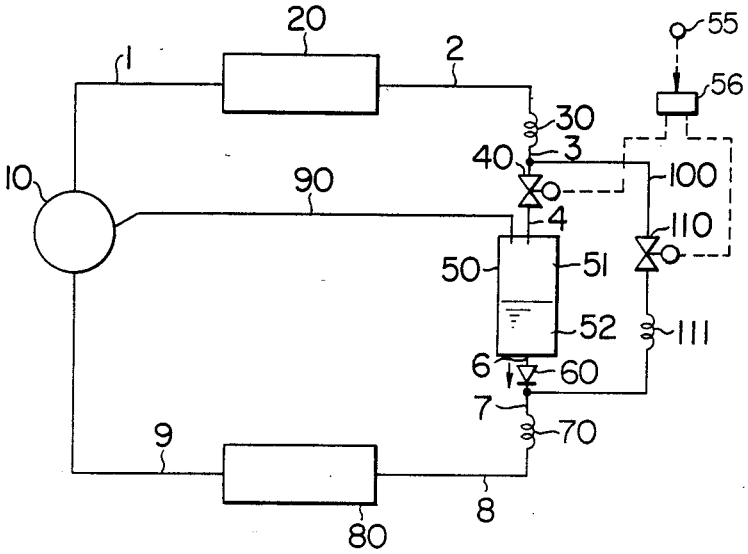
FIG. 1 is a refrigerant circuit diagram of a refrigeration system in accordance with an embodiment of the invention.

Referring now to the drawings wherein like reference numerals are used throughout the various views to designate like parts and, more particularly, to FIG. 1, according to this figure, a refrigeration system has a compressor 10 which is connected at its discharge side to a condenser 20 through a discharge pipe 1. The liquid side of the condenser 20 is connected through a liquid outlet pipe 2 to a first pressure reducer 30 such as a capillary tube. A stop valve means 40, such as a solenoid-actuated valve, is connected at its inlet side to the first pressure reducer 30 through an outlet pipe 3 of the first pressure reducer and at its outlet side to the gas phase part 51 of the gas-liquid separator 50 through an inlet pipe 4 of the gas-liquid separator 50. A check valve 60 is connected at its inlet side to the liquid phase part 52 of the gas-liquid separator 50 through an outlet pipe 6, with an outlet side of the check valve 60 being connected to a second pressure reducer 70 such as a capillary tube through an outlet pipe 7 of the second pressure reducer 70. An evaporator 80 is connected at its inlet side to the second pressure reducer 70 through an outlet pipe 8 and at an outlet side thereof to the suction side of the compressor 10 through a pipe 9. A gas injection passage 90 has one end opens to the gaseous phase portion of the gas-liquid separator 50 and the other end connected to a compression chamber of the compressor 10. A bypass passage 100 is connected at its one end to the outlet pipe 3 and at its other end to the inlet pipe 7 so as to bypass the gas-liquid separator 50. The bypass passage 100 has a solenoid-actuated valve 110 and an auxiliary pressure reducer 111 which are connected in series.

The operation of this refrigeration system is as follows. In the gas-injection mode, the solenoid-actuated valves 40 and 110 are opened and closed, respectively, in accordance with the instructions given by a controller 56 responsive to a sensor 55 which senses the air temperature of a room. Therefore, the gaseous refrigerant separated in the gas-liquid separator 50 is injected through the gas injection passage 90 into the compression chamber of the compressor 10 in the compression stroke, thereby increasing the power of the refrigeration.

On the other hand, in the non-injection mode, the solenoid-actuated valves 40 and 110 are closed and opened, respectively, so that the refrigerant liquefied in the condenser 20 flows into the evaporator 80. The pressure of the liquid refrigerant entering the evaporator 80 has been reduced as the refrigerant flows through a series of pressure reducers such as the first pressure reducer 30, auxiliary pressure reducer 111 and the second pressure reducer 70. The check valve 60 effectively presents the refrigerant from flowing into the gas-liquid separator 50 from the pipe 7. Thus, in this mode, the gas-liquid separator 50 is disconnected from the main line of the refrigerant circuit.

The flow rate of the refrigerant through the first pressure reducer 30 is smaller than that in the gas-injection mode. It is, therefore, necessary to increase the resistance imposed by the first pressure reducer 30 in the non-injection mode. In this embodiment, however, the total flow resistance in the non-injection mode is optimized by the auxiliary pressure reducer 111 and an optimum degree of dryness of about 1.0 of the refrigerant is obtained at the outlet side of the evaporator.

Since the optimum flow rate of the refrigerant is substantially equal in both modes, it is necessary to store the liquid refrigerant in the gas-liquid separator 50 also in the non-injection mode. In this embodiment, the pressure in the gas-liquid separator 50 is lower than that at the inlet side of the second pressure reducer 70 in the non-injection mode. In addition, the solenoid-actuated valve 40 and the check valve 60 are provided to disconnect the gas-liquid separator from the main line of the refrigerant circuit. Therefore, the gas-liquid separator 50 holds the liquid refrigerant which has been accumulated before the refrigerant circuit is switched to the non-injection mode. Consequently, the gas-liquid separator 50 serves as a receiver which adjusts the amount of the refrigerant. This receiver operates in response to the ambient air temperature, such that the evaporation is enhanced to reduce the amount of the liquid refrigerant when the ambient air temperature is high, while, when the ambient air temperature is low, the condensation is promoted to increase the amount of the liquid refrigerant.

On the other hand, in the operation under the gas-injection mode, the refrigerant is depressurized to an intermediate pressure through the first pressure reducer 30 before it enters the gas-liquid separator 50, and the refrigerant coming out of the separator 50 is depressurized to the desired low pressure through the second pressure reducer 70. In the non-injection mode, as stated before, the refrigerant pressure is decreased to the desired low pressure as it flows through three pressure reducers, namely, the first pressure reducer 30, auxiliary pressure reducer 111 and the second pressure reducer 70. In this embodiment, therefore, it is possible to obtain an optimum flow rate of the refrigerant, as well as an optimum degree of dryness of refrigerant at the evaporator outlet, regardless of whether the refrigeration cycle is in the gas-injection mode or in the non-injection mode.

Figure 2:
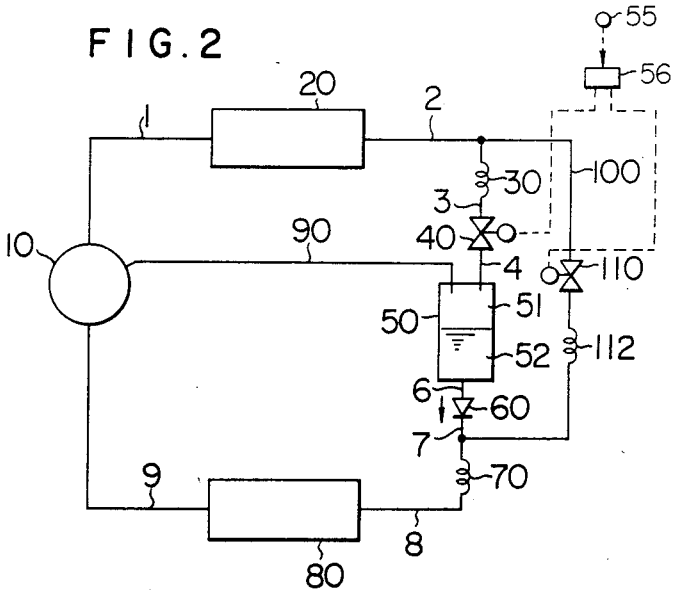
FIG. 2 is a refrigerant circuit diagram of a refrigeration system in accordance with another embodiment of the invention.

As shown in FIG. 2, the bypass passage 100 is connected at its one end to the liquid pipe 2 of the condenser 20 and at its other end to the pipe 7. In this embodiment, the auxiliary pressure reducer 112 has to provide a resistance which is the sum of the resistance provided by the first pressure reducer 30 and the additional resistance corresponding to the resistance of the auxiliary pressure reducer 111 in the embodiment shown in FIG. 1. Other portions are materially identical to those of the embodiment of FIG. 1.

Figure 3:
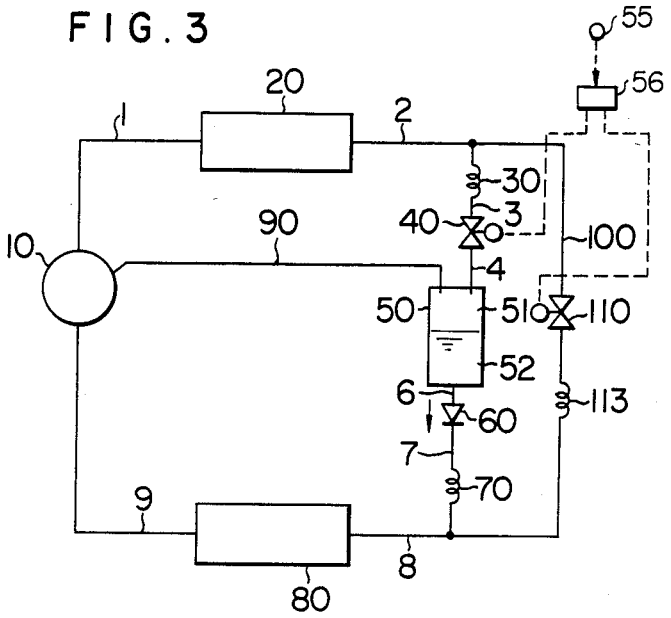
FIG. 3 is a refrigerant circuit diagram of a refrigeration system in accordance with still another embodiment of the invention.

In FIG. 3, the bypass pipe 100 is connected at its one end to the liquid pipe 2 of the condenser 20 while the other end is connected to the inlet side of the evaporator 80.

In this case, the auxiliary pressure reducer 113 should have a resistance which is the sum of the resistances of the first and second pressure reducers 30 and 70 and the additional resistance corresponding to the resistance produced by the auxiliary pressure reducer 111 of the first embodiment. Other portions are materially identical to those of the embodiment of FIG. 1.

Figure 4:
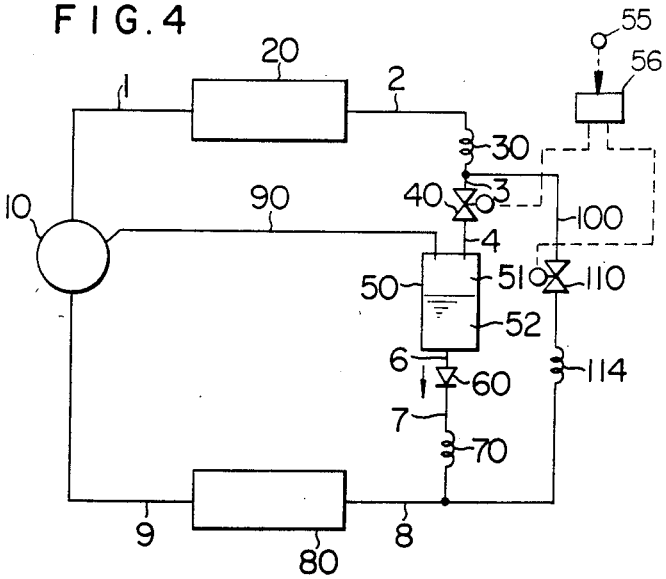
FIG. 4 is a refrigerant circuit diagram of a refrigeration system in accordance with a further embodiment of the invention.

In FIG. 4, the bypass pipe 100 is connected at its one end to the pipe 3 and at its other end to the pipe 8. In this embodiment, the auxiliary pressure reducer 114 has to provide a resistance which is the sum of the resistance provided by the second pressure reducer 70 and the additional resistance corresponding to the resistance of the auxiliary pressure reducer 111 in the first embodiment. Other portions are materially identical to those of the embodiment of FIG. 1.

Figure 5:
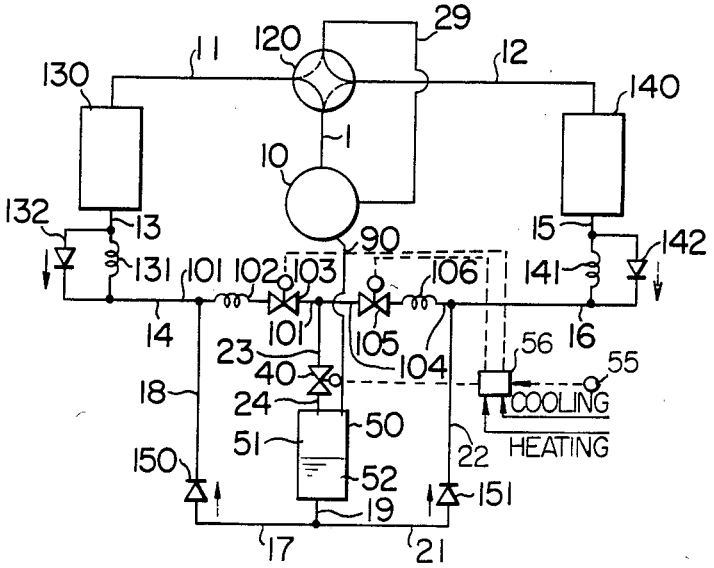
FIG. 5 is a refrigerant circuit diagram of a heat-pump type refrigeration system in accordance with a still further embodiment of the invention.

FIG. 5 shows a a heat-pump type refrigerant circuit for heating or cooling purpose wherein the discharge pipe 1 of the compressor 10 is connected to a four-way valve 120 which, in turn, is connected to an outdoor heat exchanger 130 through a pipe 11. The four-way valve 120 is connected also to an indoor heat exchanger 140 through a pipe 12. The remaining passage from the four-way valve 120 is connected to the suction side of the compressor 1 through a pipe 29. The other end of the outdoor heat exchanger 130 is connected through a pipe 13 to parallel passages which have, respectively, a check valve 132 and a second pressure reducer 131 for heating operation. The other ends of these parallel passages are connected commonly to a pipe 14, with the pipe 14 leading to a pipe 101 in which a first pressure reducer 102 for cooling and a solenoid-actuated valve 103 are connected in series. The end of the solenoid-actuated valve 103 remote from the first pressure reducer 102 is connected to a pipe 23 which leads to the inlet side of the gas-liquid separator 50. More specifically, the pipe 23 has the solenoid-actuated valve 40 and is connected to the upper part of the gas-liquid separator 50.

The other end of the indoor heat exchanger 140 is connected through a pipe 15 to parallel passages having, respectively, a check valve 142 and a second pressure reducer 141 for cooling. The other ends of these parallel passages merge in a pipe 16 connected to a pipe 104 having a series connection of the first pressure reducer 106 for heating and a solenoid-actuate valve 105. The end of the solenoid-actuated valve 105 remote from the pressure reducer 106 is connected to the pipe 23 leading the solenoid-actuated valve 40. A pipe 19 is connected to the wall of the bottom portion of the gas-liquid separator 50 so as to open to the liquid phase part 52 of the separator 50. The pipe 19 is branched into two pipes 17 and 21. The pipe 17 is connected through a check valve 150 to a pipe 18 which merges in the pipe 14. The other pipe 21 is connected through a check valve 151 to a pipe 22 which merges in the pipe 16.

The gas injection passage 90 has one end opening to the gaseous phase part 51 of the gas-liquid separator 50 and the other end connected to the compression chamber of the compressor 10.

The operation of the embodiment of FIG. 5 is as follows.

In the cooling operation of the heat pump, the four-way valve 120 takes a position as illustrated by full line in FIG. 5. Consequently, the refrigerant flows in the direction indicated by full-line arrows. On the other hand, for heating operation of the heat pump, the four-way valve is switched to the position shown by broken line so that the refrigerant flows as indicated by broken-line arrows.

The cooling operation of the embodiment of FIG. 5 with gas injection is as follows. The solenoid-actuated valves 103 and 40 are opened, while the solenoid-actuated valve 105 is closed, in accordance with the instructions given by a controller 56 responsive to a sensor 55 sensitive to the air temperature in a room. The refrigerant discharged from the compressor 10 is recycled to the latter through a circuit which is constituted by the four-way valve 120, the pipe 11, the outdoor heat exchanger 130, the pipe 13, the check valve 132, the pipe 14, the first pressure reducer 102 for cooling, the solenoid-actuated valve 103, the solenoid-actuated valve 40, the gas-liquid separator 50, the pipes 19,21, the check valve 151, the pipes 22,16, the second pressure reducer 141 for cooling, the pipe 15, the indoor heat exchanger 140, the pipe 12, the four-way valve 120 and the pipe 29. Meanwhile, the gaseous refrigerant separated in the gas-liquid separator 50 is injected into the compression chamber of the compressor 10 through the gas injection passage 90, thereby enhancing the refrigeration power of the refrigeration cycle.

The heating operation of the heat pump with the gas injection is as follows. In this case, the solenoid-actuated valve 105 and the solenoid-actuated valve 40 are opened while the solenoid-actuated valve 103 is closed, in accordance with the instructions given by the sensor 55 sensitive to the air temperature in the room. The refrigerant discharged from the compressor 10 is recycled to the same through a circuit constituted by the four-way valve 120, the pipe 12, the indoor heat exchanger 140, the check valve 142, the pipe 16, the first pressure reducer 106 for heating, the solenoid-actuated valve 105, the pipe 23, the solenoid-actuated valve 40, the gas-liquid separator 50, the pipes 19,17, the check valve 150, the pipes 18,14, the second pressure reducer 131 for heating, the outdoor heat exchanger 130, the pipe 11, the four-way valve 120 and the pipe 29. Meanwhile, the gaseous refrigerant separated in the gas-liquid separator 50 is injected into the compression chamber of the compressor 10 through the gas injection passage 90, thereby enhancing the power of the heat pump.

The operation of the embodiment of FIG. 5 in the noninjection mode is as follows. For the cooling operation of the heat pump in the non-injection mode, the pipe 104 having the first pressure reducer for heating, which is usually closed in the cooling operation, is utilized as the bypass passage. Thus, the first pressure reducer 106 for heating and the solenoid-actuated valve 104 in this pipe 104 are used as an auxiliary pressure reducer and as a bypass solenoid-actuated valve, respectively. In contrast, for the heating operation without gas injection, the pipe 101 having the first pressure reducer 102 for cooling, which is normally closed in the heating operation, is utilized as the bypass passage in the heating operation. Thus, the first pressure reducer 102 for cooling and the solenoid-actuated valve 103 are utilized as the auxiliary pressure reducer and the bypass solenoid-actuated valve, respectively.

More specifically, in the cooling operation without gas injection, the solenoid valve 40 at the inlet side of the gas-liquid separator 50 is closed, while the solenoid-actuated valve 103 for the first pressure reducer for cooling and the solenoid-actuated valve 105 for the bypass passage, i.e. the solenoid-actuated valve for the first pressure reducer for heating, are opened, in accordance with the instructions given by the sensor 55 sensitive to the air temperature in the room.

The refrigerant coming out of the outdoor heat exchanger 130 flows into the bypass pipe 104 through the check valve 132, the pipe 14, the first pressure reducer 102 for cooling and the solenoid valve 103. The refrigerant then flows into the pipe 16 through the solenoid-actuated valve 105 and the auxiliary pressure reducer 106 in the bypass pipe 104 and is introduced into the indoor heat exchanger 140 through the second pressure reducer 141 for cooling.

On the other hand, in the heating operation without gas injection, the solenoid-actuated valve 40 at the inlet side of the gas-liquid separator 50 is closed, while the solenoid-actuated valve 105 for the first pressure reducer for heating and the bypass solenoid-actuated valve 103, i.e. the solenoid-actuated valve for the first pressure reducer for cooling, are opened, in accordance with the instructions given by the sensor 55 sensitive to the air temperature in the room. Therefore, the refrigerant coming out of the indoor heat exchanger 140 flows into the bypass pipe 101 through the check valve 142, the pipe 16, the first pressure reducer 106 for heating and the solenoid-actuated valve 105. The refrigerant then flows through the solenoid-actuated valve 103 and the auxiliary pressure reducer 102 in the bypass pipe 101 and is introduced to the outdoor heat exchanger 130 through the second pressure reducer 131 for heating.

Thus, in both of the cooling and heating operations of the heat pump, insofar as the gas injection is not conducted, the refrigerant circulated in the refrigerant circuit bypasses the gas-liquid separator 50.

Namely, in the cooling operation, the refrigerant flows through the bypass pipe 104 so that the first pressure reducer 102, auxiliary pressure reducer 106 and the second pressure reducer 141 are connected in series, so that the desired resistance to the flow of refrigerant is produced by these three pressure reducers to reduce the refrigerant pressure to the desired low level.

On the other hand, in the heating operation, the refrigerant flows through the bypass pipe 101 so that three pressure reducers 106, 102 and 131 are connected in series so that the desired resistance to the flow of refrigerant is produced by these three pressure reducers to reduce the refrigerant pressure to the desired low level.

Since the solenoid-actuated valve 40 is closed, the pressure in the gas-liquid separator 50 comes down below the pressures at the inlet side of each second pressure reducer 141 or 131. However, since the reverse flow of the refrigerant is checked by the check valves 150 and 151, the liquid refrigerant in the gas-liquid separator 50 is held in the latter. Thus, the gas-liquid separator 50 serves as a receiver for adjusting the amount of the refrigerant. The function of the gas-liquid separator 50 serving as a receiver is particularly significant in adjusting the amount of refrigerant necessary for the heating or cooling operation of the heat pump. Namely, since the heating operation of the heat pump requires smaller rate of circulation of the refrigerant than the cooling operation of the same, the surplus refrigerant is stored in the gas-liquid separator 50 serving as the receiver, in the heating operation of the heat pump.

Figure 6:
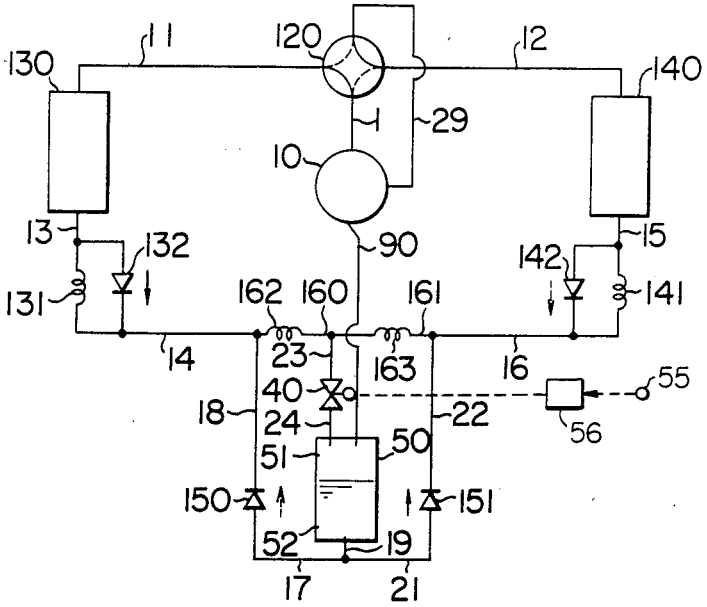
FIG. 6 is a refrigerant circuit diagram of a heat-pump type refrigeration system in accordance with a still further embodiment of the invention.

As shown in FIG. 6, a pipe 160 has only a first pressure reducer 162 for cooling which works as the auxiliary pressure reducer in the non-injection mode, while a pipe 161 is provided only with a first pressure reducer 163 for heating which serves as the auxiliary pressure reducer in the non-injection mode. That is, the solenoid-actuated valves 103, 105 used in the embodiment of FIG. 5 are omitted. Other portions are materially identical to the embodiment shown in FIG. 5.

In the embodiment of FIG. 6, in the cooling operation with gas injection, the refrigerant from the pipe 14 is depressurized to an intermediate pressure by the first pressure reducer 162 for cooling. Then, the refrigerant flows into the gas-liquid separator 50 via the pipe 160, through the passage which provided smaller resistance, i.e. through the pipe 23, the solenoid-actuated valve 40 and the pipe 24, but does not flow into the passage producing greater flow resistance, i.e. the pressure reducer 163. On the other hand, in the heating operation of the heat pump, the refrigerant flows into the gas-liquid separator 50 from the pipe 16, via the pipe 161, first pressure reducer 163 for heating, the pipe 23, solenoid-actuated valve 40 and the pipe 24, but does not flow towards the pressure reducer 162 in the pipe 160.

Figure 7:
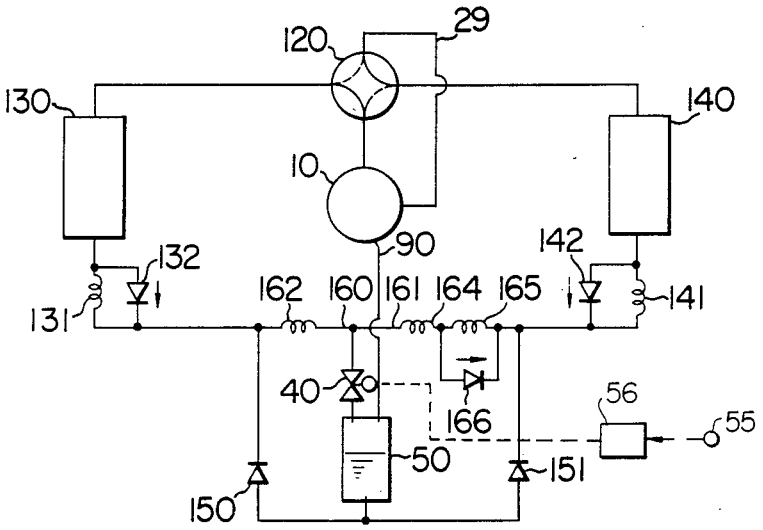
FIG. 7 is a refrigerant circuit diagram of a heat-pump type refrigeration system in accordance with a still further embodiment of the invention.

In FIG. 7, the pressure reducer in the pipe 161 is divided into a first pressure reducer section 164 and a second pressure reducer section 165, and a check valve 166 is connected in parallel with one 165 of the pressure reducer sections. Other portions are materially identical to those of the embodiment shown in FIG. 5.

In the embodiment of FIG. 7, in the heating operation of the heat pump, the first and second pressure reducer sections 165 and 164 are connected in series to constitute the first pressure reducer for heating, regardless of whether the gas injection is conducted or not. In the cooling operation without the gas injection, the check valve 166 permits the refrigerant to flow therethrough, so that the pressure reducer section 164 solely constitutes the auxiliary pressure reducer in the bypass passage. It will be seen that, in the embodiment of FIG. 7, the flow resistance imposed by the first pressure reducer for heating in the heating operation, as well as the flow resistance produced by the bypassing auxiliary pressure reducer in the cooling operation without gas injection, is optimized advantageously. In the cooling operation without gas injection, the flow resistance produced by the pressure reducers as a whole is decreased by an amount corresponding to the resistance produced by the pressure reducer section 165, as compared with the heating operation of the heat pump.

Although the invention has been described through specific terms, it is to be noted here that the described embodiments are not exclusive and various changes and modifications may be imparted thereto without departing from the scope of the invention which is limited solely by the appended claims.

What is claimed is:

1. A refrigeration system having a main refrigerant circuit including a compressor, a condenser, a first pressure reducer, a gas-liquid separator including an inlet and outlet pipe, a second pressure reducer and an evaporator connected in series to form a closed loop, and a gas injection passage providing a communication between a gaseous phase part of said gas-liquid separator and a compression chamber of said compressor, a stop valve means disposed in the inlet and outlet pipes of said gas-liquid separator for opening and closing the inlet and outlet pipes when injection of a refrigerant to said compressor is conducted and when the injection is not conducted, respectively, and a bypass passage directly connecting an outlet pipe of said condenser to an inlet pipe of said evaporator to bypass said gas-liquid separator, said stop valve means being adapted to be controlled such that, when the gas injection to said compressor through gas injection passages is not conducted, the refrigerant flows through said bypass passage bypassing said gas-liquid separator, while said gas-liquid separator functions as a receiver for adjusting the amount of refrigerant circulated in said main refrigerant circuit.

2. A refrigeration system according to claim 1, wherein said stop valve means includes a solenoid-actuated valve disposed in the inlet pipe to said gas-liquid separator and a check valve disposed in said outlet pipe from said gas-liquid separator and adapted to prevent reversing flow of the refrigerant into said gas-liquid separator.

3. A refrigeration system according to claim 1, wherein said bypass passage comprises pipes having a series connection of a solenoid-actuated valve and an auxiliary pressure reducer.

4. A refrigeration system according to claim 2, wherein said bypass passage is connected at its one end to the inlet side of said solenoid-actuated valve in said inlet pipe to said gas-liquid separator, while the other end of the same is connected to an inlet pipe of the second pressure reducer between said check valve in said outlet pipe from said gas-liquid separator and said second pressure reducer.

5. A refrigeration system according to claim 2, wherein said bypass passage is connected at its one end to the outlet pipe from said condenser while the other end is connected to an inlet pipe of the second pressure reducer between said check valve in the outlet pipe from said gas-liquid separator and said second pressure reducer.

6. A refrigeration system according to claim 2, wherein said bypass passage is connected at its one end to the outlet pipe from said condenser while the other end is connected to an outlet pipe of said second pressure reducer.

7. A refrigeration system according to claim 2, wherein said bypass passage is connected at is one end to an inlet pipe to said solenoid-actuated valve in said inlet pipe to said gas-liquid separator, while the other end is connected to an outlet pipe from said second pressure reducer.

8. A refrigeration system according to claim 1, wherein said pressure reducers comprise capillary tubes.

9. A refrigeration system according to claim 3, wherein said auxiliary pressure reducer comprises a capillary tube.

10. A refrigeration system comprising: a heat-pump type refrigerant circuit including a compressor, a four-way valve, an outdoor heat exchanger, a pressure reducer for heating connected in parallel to a first check valve, a gas-liquid separator, a pressure reducer for cooling connected in parallel to a second check valve and indoor heat exchanger connected in series, said four-way valve being adapted to be switched over to switch the connection between said heat exchangers and the inlet and outlet pipes of said compressor; and a gas injection passage providing a communication between the gaseous phase part of said gas-liquid separator and a compression chamber of said compressor; said pressure reducer for heating is used as a second pressure reducer for ehating while said pressure reducer for cooling is used as a second pressure reducer for cooling; a stop valve means is disposed in the inlet pipe to said gas-liquid separator for opening and closing said ilet pipe when the injection of a refrigerant to said compressor is conducted and when the injection to said compressor is conducted and when the injection is not conducted, respectively; when said heat-pump type refrigerant circuit operates for cooling, the outlet side of said outdoor heat exchanger is connected to said second pressure reducer for cooling, through said first check valve, a first pressure reducer for cooling, the stop valve means in the inlet pipe to said gas-liquid separator, interior of said gas-liquid separator, bottom of said gas-liquid separator, and a third check valve, whereas, when said heat-pump type refrigerant circuit operates for heating, the outlet side of said indoor heat exchanger is connected to said second pressure reducer for heating, through said second check valve, a first pressure reducer for heating, the stop valve means in the inlet pipe to said gas-liquid separator, interior of said gas-liquid separator, bottom of said gas-liquid separator and a fourth check valve; and when said heat-pump type refrigerant circuit operates for cooling without gas injection, said first pressure reducer for cooling and said second pressure reducer for cooling are conected by a bypass passage for cooling bypassing said gas-liquid separator, whereas when said heat-pump type refrigerant circuit operates for heating without gas injection, said first pressure reducer for heating and said second pressure reducer for heating are connected through a bypass passage for heating bypassing said gas-liquid separator; whereby, when the injection of the refrigerant to said compressor is not conducted, the flows through either of said bypass passage for cooling and said bypass passage for heating bypassing said gas-liquid separator, while said gas-liquid separator serves as a reservoir for adjusting the amount of the refrigerant circulated through said refrigerant circuit.

11. A refrigeration system according to claim 10, wherein each of said bypass passage for cooling and said bypass passage for heating comprises pipes having an auxiliary pressure reducer connected between them.

12. A refrigeration system according to claim 10, wherein the pipe having said first pressure reducer for heating serves as said bypass passage for cooling.

13. A refrigeration system according to claim 10, wherein the pipe having said second pressure reducer for cooling serves as said bypass passage for heating.

14. A refrigeration system according to claim 10, wherein a stop valve is disposed in each of the pipe having said first pressure reducer for cooling and the pipe having said first pressure reducer for heating.

15. A refrigeration system according to claim 11, wherein said auxiliary pressure reducer in said bypass passage for cooling produces a flow resistance which is smaller than that produced by said auxiliary pressure reducer in said bypass passage for heating.

16. A refrigeration system according to claim 11, wherein said auxiliary pressure reducer in said bypass passage for cooling is divided into a first pressure reducer section and a second pressure reducer section which are connected in series, one of said pressure reducer sections having a check valve connected in parallel thereto.

17. A refrigeration system according to claim 10, wherein said pressure reducers comprise capillary tubes.

18. A refrigeration system according to claim 11, wherein said auxiliar pressure reducers comprise capillary tubes.

* * * * *